US008651817B2

(12) United States Patent
Radomski

(10) Patent No.: US 8,651,817 B2
(45) Date of Patent: Feb. 18, 2014

(54) AEROFOIL BLADE ASSEMBLY

(75) Inventor: Steven A. Radomski, Nottingham (GB)

(73) Assignee: Rolls-Royce PLC, London (GB)

( * ) Notice: Subject to any disclaimer, the term of this patent is extended or adjusted under 35 U.S.C. 154(b) by 712 days.

(21) Appl. No.: 12/850,957

(22) Filed: Aug. 5, 2010

(65) Prior Publication Data

US 2011/0052399 A1 Mar. 3, 2011

(30) Foreign Application Priority Data

Aug. 28, 2009 (GB) ..... 0914969.1

(51) Int. Cl.
*F04D 29/34* (2006.01)
*F04D 29/32* (2006.01)

(52) U.S. Cl.
USPC ..... 416/204 R; 416/204 A; 416/219 R; 416/220 R; 416/221; 29/889.2

(58) Field of Classification Search
USPC ..... 416/204 R, 219 R, 220 R, 221, 204 A; 29/889.2
See application file for complete search history.

(56) References Cited

U.S. PATENT DOCUMENTS 4,478,554 A * 10/1984 Surdi ..... 416/221
4,915,587 A * 4/1990 Pisz et al. ..... 416/220 R
5,151,013 A * 9/1992 Moore ..... 416/221
5,624,233 A 4/1997 King et al.
5,860,787 A * 1/1999 Richards ..... 416/220 R
7,442,011 B2 * 10/2008 Negulescu et al. ..... 416/221

FOREIGN PATENT DOCUMENTS

GB 2 299 834 A 10/1996
GB 2 313 162 A 11/1997

OTHER PUBLICATIONS

Search Report issued in British Patent Application No. 0914969.1, on Dec. 4, 2009.

* cited by examiner

*Primary Examiner* — Igor Kershteyn
(74) *Attorney, Agent, or Firm* — Oliff PLC

(57) ABSTRACT

An aerofoil blade assembly having a rotor disc having a radially outer surface provided with an axial slot and a radially inner surface provided with a circumferential slot, wherein the lower region of the axial slot intersects the upper region of the circumferential slot; an aerofoil blade having a blade root which is received by the axial slot and which is provided with a locating slot which corresponds to the circumferential slot; a retention key which engages with the circumferential slot and the locating slot to restrict axial displacement of the aerofoil blade with respect to the rotor disc, the retention key being provided with a socket which, when the retention key is engaged in the circumferential slot and the locating slot, is substantially aligned with the axial slot.

14 Claims, 3 Drawing Sheets

AEROFOIL BLADE ASSEMBLY

This invention relates to an aerofoil blade assembly, and is particularly, although not exclusively, concerned with a fan blade assembly for a gas turbine engine provided with a retention key which prevents incorrect assembly of the fan blade assembly.

Fan rotor assemblies in large turbofans typically comprise rotor discs provided with individual fan blades. The rotor discs have axially extending dovetail slots (which may be straight or curved) disposed about the circumference of the disc into which the fan blades, which have corresponding dovetail roots, are inserted. The dovetail slots secure the fan blades in the radial and circumferential directions, but not in the axial direction. During operation, the fan blades are subject to axial loads generated, for example, by thrust or by debris impacting on the blades. It is therefore necessary to secure the blade roots within the dovetail slots in an axial direction.

U.S. Pat. No. 5,624,233 describes use of a retention key, in particular a shear key, to restrain a fan blade within a dovetail slot. The shear key is generally U-shaped. The underside of the blade root is provided with a slot across its mid portion into which the shear key locates. The profile of the shear key is larger than that of the blade root and consequently, the shear key protrudes beyond the profile of the blade root. In particular, the shear key protrudes from the blade flanks.

The dovetail slot in the rotor disc has a profile which is larger than the profile of the shear key. The blade root and the shear key can thus be inserted along the slot. In addition, the rotor disc is provided with a circumferential slot about its inner surface which intersects the dovetail slot. The width of the circumferential slot corresponds to the thickness of the shear key. To attach the blade, the blade root and the shear key are inserted along the dovetail slot until the shear key is aligned with the circumferential slot. The blade root and the shear key are then displaced radially outwardly by insertion of a chocking member between the blade root and the bottom of the dovetail slot. The flanks of the blade root are thereby engaged with the flanks of the dovetail slot. At the same time, the shear key engages with the circumferential slot. The sides of the shear key abut the sides of the circumferential slot and prevent axial displacement of the blade root within the dovetail slot. Correct insertion of the fan blade necessitates correct insertion of the shear key. Consequently, it is possible to determine that the shear key has been correctly inserted by viewing the fan blade from above the dovetail slot.

A disadvantage associated with the shear key disclosed by U.S. Pat. No. 5,624,233 is that the circumferential slot in the rotor disc must be provided through the flanks of the dovetail slot in order to accommodate the radial displacement of the shear key. This introduces a discontinuity into the dovetail slots which, during operation of the turbofan, leads to high stress concentrations at the edges formed by the intersection of the dovetail and circumferential slots. Moreover, the reduction in contact area of the flanks of the dovetail slot results in an increase in the contact stress between the flanks of the blade root and the dovetail slot.

In addition, the profile of the dovetail slot must be large enough to accommodate the larger profile of the shear key so that the shear key can be inserted along the slot. This reduces the cross-sectional area of the disc finger (i.e. region of the rotor between adjacent slots) which has a detrimental effect on neck stress with respect to both high cycle fatigue and unzipping characteristics.

Manufacturing disadvantages are also associated with the shear key disclosed by U.S. Pat. No. 5,624,233; for example, the circumferential slot machined in the rotor disc is a blind slot making it costly to manufacture. Also, the blade flanks are often provided with a compressive layer by treating the flanks using costly processes such as laser shock peening (LSP). For continuous uninterrupted flanks less costly methods such as low plasticity burnishing can be employed to introduce the compressive layer.

It is known that a slot can be provided in the lower surface of the blade root which does not extend through the flanks of the blade. In such configurations, the shear key is engaged with the blade root and the rotor disc after insertion of the blade into the dovetail slot. However, since the shear key is inserted after the fan blade has been located in the dovetail slot, it is difficult to determine whether the shear key has been inserted correctly or not.

In this specification, the terms "axial", "radial" and "circumferential" are defined with respect to the axial direction of the rotor disc unless otherwise specified.

According to the present invention there is provided an aerofoil blade assembly comprising: a rotor disc having a radially outer surface provided with an axial slot and a radially inner surface provided with a circumferential slot, wherein the lower region of the axial slot intersects the upper region of the circumferential slot; an aerofoil blade comprising a blade root which is received by the axial slot and which is provided with a locating slot which corresponds to the circumferential slot; a retention key which engages with the circumferential slot and the locating slot to restrict axial displacement of the aerofoil blade with respect to the rotor disc, the retention key being provided with a socket which, when the retention key is engaged in the circumferential slot and the locating slot, is substantially aligned with the axial slot; and a slider for insertion along the axial slot, the slider having an engaging portion for engaging with the socket which, unless aligned with the socket upon insertion of the slider into the axial slot, is obstructed by the retention key such that the slider cannot be fully inserted into the slot.

The socket may comprise an aperture, which may be a through hole.

The engaging portion may comprise a prong. The prong may be tapered to aid engagement.

The retention key may be provided with a stop which, when the retention key is inserted into the circumferential slot through the axial slot, prevents the retention key from passing completely through the circumferential slot.

The slot may comprise tags which extend axially in opposite directions from the retention key such that they overhang the edges of the circumferential slot.

The retention key may comprise a resilient element about its periphery for securing the retention key within the circumferential slot. The resilient element may comprise an O ring and may be made from any suitable material such as neoprene or rubber.

The resilient element may be located in a groove formed in the retention key.

The retention key may be provided with two apertures between which is provided a recess for accommodating the fan blade root when inserted in the slot.

The fan blade may comprise a shoe secured to the blade root.

The locating slot may be a locking recess provided in the shoe.

The shoe may have a ramped lower surface for displacing a retention key when the fan blade is inserted into the axial slot.

The slider may be provided with a recess for accommodating the shoe when the slider is inserted into the axial slot.

According to another aspect of the present invention there is provided a method of assembling an aerofoil blade assembly comprising the steps: a. disposing the retention key within the circumferential slot at the intersection with the axial slot such that the socket is aligned with the axial slot; b. inserting the blade root along the axial slot to align the locating slot with the circumferential slot; c. while the locating slot is aligned with the circumferential slot, displacing the retention key radially outwardly so that the retention key engages the locating slot and the circumferential slot; d. inserting a slider between the blade root and a surface of the slot such that the engaging portion of the slider engages the socket provided in the retention key.

For a better understanding of the present invention, and to show more clearly how it may be carried into effect, reference will now be made, by way of example, to the accompanying drawings, in which.

Figure 1:
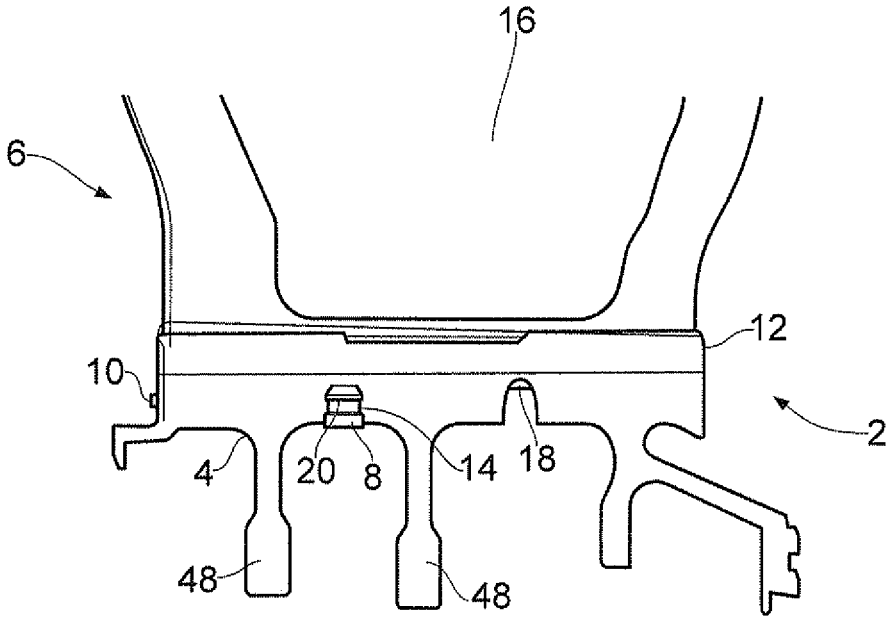
FIG. 1 shows a sectional view of a fan blade assembly.

FIG. 1 shows a fan blade assembly 2 comprising a rotor disc 4 supporting a fan blade 6, in which the fan blade 6 is secured to the rotor disc 4 by a retention key 8 and a slider 10.

Figure 2:
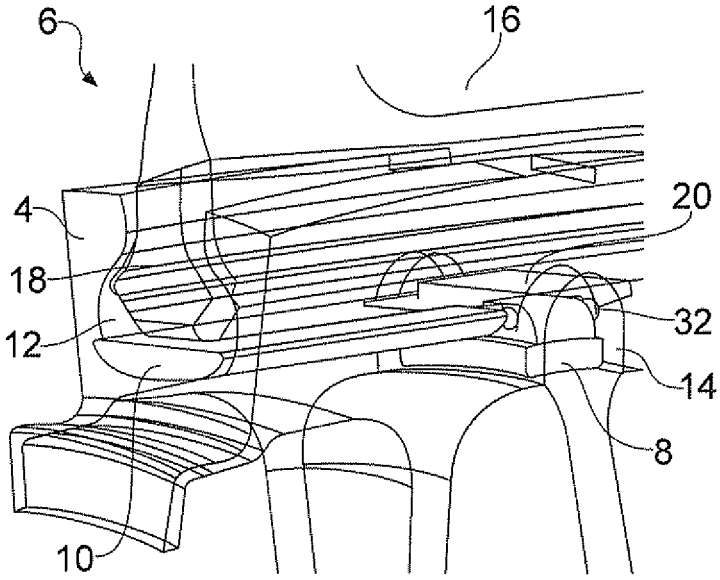
FIG. 2 shows a partial perspective view of the fan blade assembly shown in FIG. 1.

The rotor disc 4 is provided with an axial slot 12. The axial slot 12 is one of a plurality of axial slots arranged circumferentially about the periphery of the rotor disc 4 which extend in a direction parallel to the rotational axis of the rotor disc 4. As shown in FIG. 2, the fan blade 6 comprises an aerofoil section 16, a blade root 18 and a shoe 20 secured to the bottom surface of the blade root 18. The blade root 18 and the axial slot 12 form a dovetail connection. The flanks of the blade root 18 thus abut the flanks of the axial slot 12 to secure the fan blade 6 in a radial and circumferential direction.

The rotor disc 4 is provided with a circumferential slot 14 in a radially inner surface of the rotor disc 4. The radially outer region of the circumferential slot 14 intersects the radially inner region of the axial slot 12. The circumferential slot 14 does not extend through the flanks of the axial slot 12.

Figure 3:
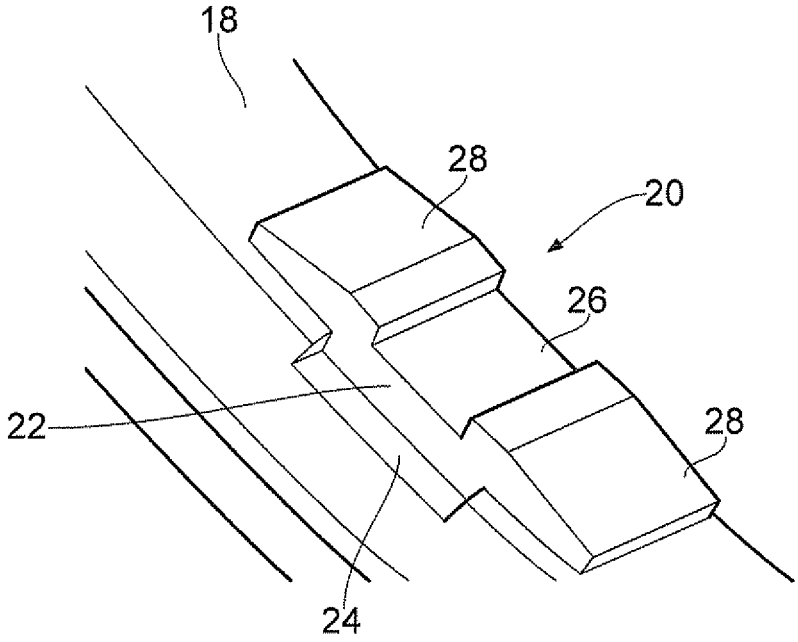
FIG. 3 shows a partial perspective view of a blade root provided with a shoe.

As shown in FIG. 3, the shoe 20 extends along the base of the blade root 18. The shoe 20 has a central raised portion 22 which engages with a recess 24 provided in the base of the blade root 18. The shoe 20 is provided with a locking recess 26 opposite the central raised portion 22 for engagement with the retention key 8 (explained below). The width of the locking recess 26, which is defined in the axial direction, corresponds to the width of the upper portion of the retention key 8. The shoe 20 is further provided with ramped end sections 28 which are inclined in a direction away from the locking recess 26 and towards the blade root 18.

Figure 4:
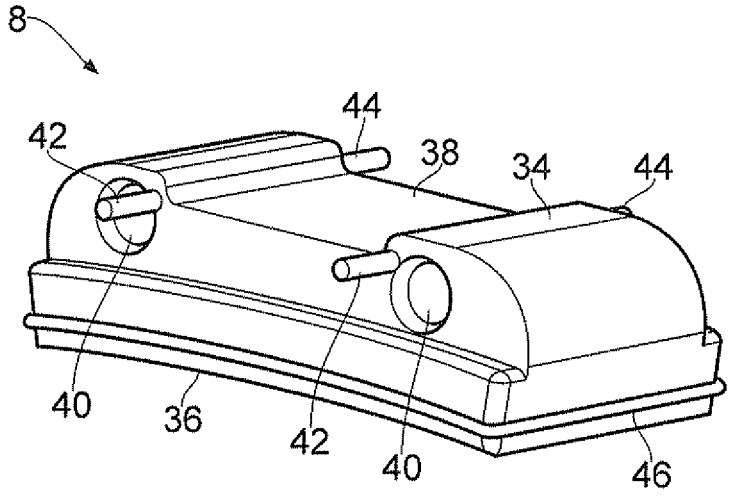
FIG. 4 shows a perspective view of a retention key.

The retention key 8 shown in FIG. 4 has a lower portion having a width which corresponds to the width of the circumferential slot 14, and an upper portion having a width which corresponds to the width of the locking recess 26. The lower portion is wider than the upper portion and thus forms a ledge along two sides of the retention key 8. The retention key 8 has a radially outer surface 34 and a radially inner surface 36. The inner surface 36 has a curvature which corresponds to the curvature of the surface of the rotor disc 4 in which the circumferential slot 14 is provided. The outer surface 34 is provided with a recess 38 which cooperates with the locking recess 26 provided in the shoe 20.

Figure 5:
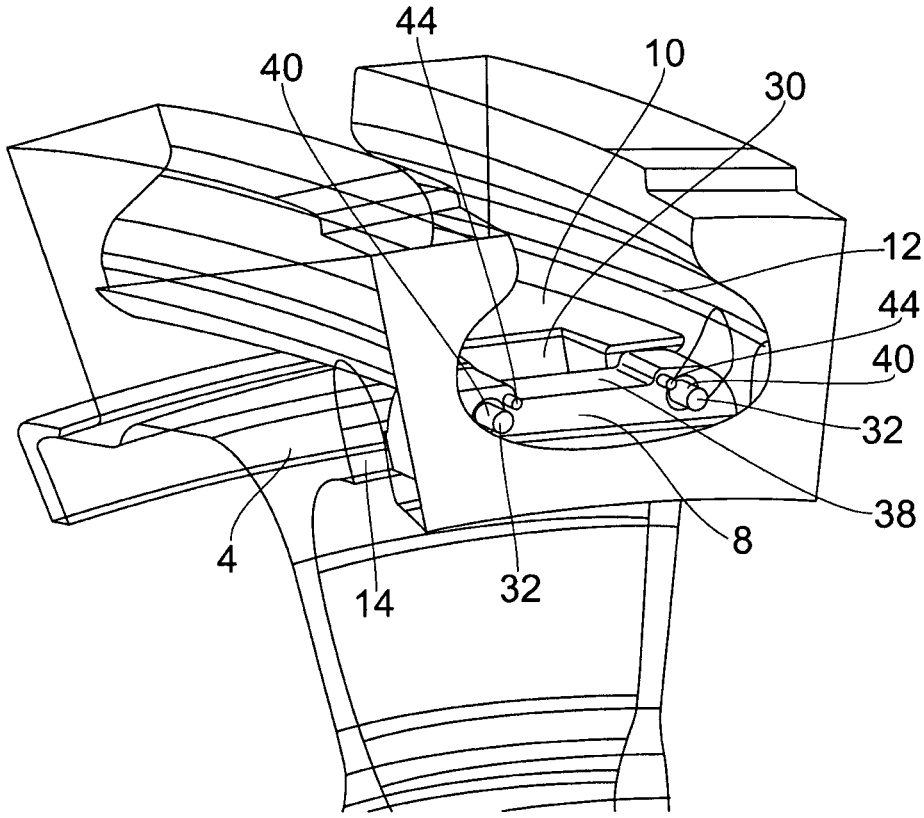
FIG. 5 shows a partial perspective view of part of the fan blade assembly shown in FIG. 1.

Four tangs 42, 44 extend from the sides of the main body of the retention key 8. Two of the tangs 42 extend in an opposite direction to the two other tangs 44. As shown in FIG. 5, the retention key 8 is disposed within the circumferential slot 14 such that the tangs 42, 44 extend in the axial direction and project into the axial slot 12. The tangs 42, 44 thus restrict displacement of the retention key 8 in a radially inward direction by fouling the bottom of the axial slot 12 when the retention key 8 is displaced radially inwardly.

The retention key 8 is provided with two apertures 40 which, when the retention key 8 is disposed within the circumferential slot 14, extend in the axial direction. The apertures 40 are radiused, to provide a lead-in for assembly.

The retention key is provided with a resilient ring 46 about the periphery of the lower portion. The resilient ring 46 provides friction to hold the retention key 8 in the circumferential slot 14 during assembly. The resilient ring 46 also provides vibration damping during operation.

The slider 10 is disposed between the base of the blade root 18 and the bottom of the axial slot 12. As shown in FIG. 2, the slider 10 chocks the blade root 18 against the flanks of the axial slot 12 in order to secure the blade root 16 in a radial and circumferential direction within the axial slot 12. The slider 10 is provided with a recess 30 (shown in FIG. 5) which accommodates one of the ramped portions 28 of the shoe 20. The slider 10 is further provided with two prongs 32. The prongs 32 project from the end of the slider 10 in a direction which is parallel to the length of the slider 10. The prongs 32 are spaced apart from each other with respect to the width of the slider 10. The spacing of the prongs 32 is such that the prongs 32 engage respective apertures 40 in the retention key 8. The prongs 32 are cantilevered to accommodate limited downward motion of the fan blade 6.

The fan blade assembly 2 is provided with a support ring (not shown) which attaches to the end of the rotor disc 4 from which the slider 10 is inserted. The support ring secures the slider 10 and the fan blade 6 within the axial slot 12. The support ring engages with the slider 10 such that incorrect insertion of the slider 10, for example where the slider 10 protrudes excessively from the axial slot 12, prevents the support ring from being fitted.

The fan blade assembly 2 is assembled by inserting the retention key 8 into the circumferential slot 14 via the axial slot 12 in a radially inward direction. The retention key 8 is pushed into the circumferential slot 14 until the tangs 42, 44 contact the bottom of the axial slot 12. At this point only the upper portion of the retention key 8 protrudes into the axial slot 12. The apertures 40 are aligned with the axial slot 12, but are concealed, or partially concealed, by the sides of the circumferential slot 14. The rubber ring 46 pinches between the retention key 8 and the sides of the circumferential slot 14 to hold the retention key 8 in position during assembly.

The blade root 18 and the shoe 20 are inserted along the length of the axial slot 12 until the locking recess 26 in the shoe 20 aligns with the circumferential slot 14. In circumstances where the retention key 8 has not been properly inserted into the circumferential slot 14, for example where the retention key 8 protrudes into the axial slot 8 to obstruct the shoe 20, the leading ramped portion 28 of the shoe 20 rides over the retention key 8 and displaces the retention key 8 further into the circumferential slot 14. The ramped portions 28 thus ensure that failure to insert the retention key 8 correctly does not prevent insertion of the blade root 18.

Once the locking recess 26 is aligned with the circumferential slot 14, the retention key 8 is displaced radially outwardly to engage the locking recess 26. The retention key 8 may, for example, be displaced by manually pushing the retention key 8 through the circumferential slot 14 from between the diaphragms 48 of the rotor disc 4. The apertures 40, which were concealed by the sides of the circumferential slot 14, are displaced into the axial slot 12. The lower portion of the retention key 8 remains within the circumferential slot 14. The retention key 8 is thus positioned such that it engages both the locking recess 26 and the sides of the circumferential slot 14 thereby preventing axial displacement of the fan blade 6 with respect to the rotor disc 4.

The slider 10 is inserted along the axial slot 12 between the blade root 18 and the bottom of the axial slot 12. The slider 10 displaces the fan blade 6 radially outwardly such that the flanks of the blade root 16 bear against the flanks of the axial slot 12. The prongs 32 engage the respective apertures 40 of the retention key 8. The tapering of the apertures 40 facilitates insertion of the prongs 32. The prongs 32 also serve to secure the retention key 8 in position.

Failure to assemble the retention key 8 correctly within the axial slot 12, for example, by not properly engaging the retention key 8 with the locking recess 26 provided in the shoe 20 results in the apertures 40 being incorrectly aligned with the prongs 32. Upon insertion of the slider 10, the prongs 32 will foul the retention key 8 thus preventing further insertion of the slider 10. The slider 10 will thus protrude from the axial slot 12. The protrusion provides a visible indication that the prongs 32 have not engaged the apertures 40 and consequently, indicate that the fan assembly 2 has been incorrectly assembled. It will be appreciated that it may be desirable for the slider 10 to protrude from the axial slot 12 even when correctly fitted. In such circumstances, incorrect assembly will be indicated by excessive protrusion of the slider 10. In addition, the protrusion or excessive protrusion prevents attachment of the support ring.

The invention claimed is:

1. An aerofoil blade assembly comprising:

a rotor disc having a radially outer surface provided with an axial slot and a radially inner surface provided with a circumferential slot, wherein a lower region of the axial slot intersects an upper region of the circumferential slot;

an aerofoil blade comprising a blade root which is received by the axial slot and which is provided with a locating slot which corresponds to the circumferential slot;

a retention key which engages with the circumferential slot and the locating slot to restrict axial displacement of the aerofoil blade with respect to the rotor disc, the retention key being provided with a socket which, when the retention key is engaged in the circumferential slot and the locating slot, is substantially aligned with the axial slot; and a slider for insertion along the axial slot, the slider having an engaging portion for engaging with the socket which, unless correctly aligned with the socket upon insertion of the slider into the axial slot, is obstructed by the retention key such that the slider cannot be fully inserted into the axial slot.

2. An aerofoil blade assembly according to claim 1, wherein the socket comprises a through hole.

3. An aerofoil blade assembly according to claim 1, wherein the engaging portion comprises a prong.

4. An aerofoil blade assembly according to claim 3, wherein the prong is tapered.

5. An aerofoil blade assembly according to claim 1, wherein the retention key is provided with a stop which, when the retention key is inserted into the circumferential slot through the axial slot, prevents the retention key from passing completely through the circumferential slot.

6. An aerofoil blade assembly according to claim 5, wherein the stop comprises tangs which extend axially in opposite directions from the retention key such that they overhang the edges of the circumferential slot.

7. An aerofoil blade assembly according to claim 1, wherein the retention key comprises a resilient element about its periphery for securing the retention key within the circumferential slot.

8. An aerofoil blade assembly according to claim 1, wherein the retention key is provided with two apertures between which is provided a recess for accommodating the blade root when inserted into the axial slot.

9. An aerofoil blade assembly according to claim 1, wherein the aerofoil blade comprises a shoe secured to the blade root.

10. An aerofoil blade assembly according to claim 9, wherein the locating slot is a locking recess provided in the shoe.

11. An aerofoil blade assembly according to claim 9, wherein the shoe has a ramped lower surface for displacing the retention key when the aerofoil blade is inserted into the axial slot.

12. An aerofoil blade assembly according to claim 9, wherein the slider is provided with a recess for accommodating the shoe when the slider is inserted into the axial slot.

13. A gas turbine engine having an aerofoil blade assembly as claimed in claim 1.

14. A method of assembling an aerofoil blade assembly according to claim 1 comprising the steps:

a. disposing the retention key within the circumferential slot at the intersection with the axial slot such that the socket is aligned with the axial slot;

b. inserting the blade root along the axial slot to align the locating slot with the circumferential slot;

c. while the locating slot is aligned with the circumferential slot, displacing the retention key radially outwardly so that the retention key engages the locating slot and the circumferential slot;

d. inserting a slider between the blade root and a surface of the axial slot such that the engaging portion of the slider engages the socket provided in the retention key.

* * * * *